United States Patent [19]

Aoun

[11] 4,287,677

[45] Sep. 8, 1981

[54] SET OF SIGNS TO COMPOSE TEXTS IN ARABIC LETTERS BY THEIR JUXTAPOSITION

[75] Inventor: Joseph Aoun, Beirut, Lebanon

[73] Assignee: Lettera Arabica S.a.r.l., Beirut, Lebanon

[21] Appl. No.: 3,951

[22] Filed: Jan. 16, 1979

[30] Foreign Application Priority Data

Feb. 7, 1978 [LB] Lebanon ..... 564

[51] Int. Cl.[3] ..... G09F 7/16

[52] U.S. Cl. ..... 40/595

[58] Field of Search ..... 40/584, 451, 447, 584, 40/595

[56] References Cited

U.S. PATENT DOCUMENTS

| | | | |
|---|---|---|---|
| 1,660,254 | 2/1928 | Carroll | 40/451 |
| 2,699,103 | 1/1955 | Stasikewich | 40/594 |
| 3,315,376 | 4/1967 | Nielsen | 35/35 J |
| 3,338,395 | 8/1967 | Silverstein | 40/595 |
| 3,487,578 | 1/1970 | Sudermann | 40/457 |
| 3,537,202 | 11/1970 | Braun et al. | 35/35 J |
| 3,827,043 | 7/1974 | Maezawa | 40/451 |
| 3,968,583 | 7/1976 | Allam | 40/484 X |

FOREIGN PATENT DOCUMENTS

| | | | |
|---|---|---|---|
| 758935 | 10/1952 | Fed. Rep. of Germany | 40/451 |
| 749444 | 5/1936 | United Kingdom | 35/35 J |
| 987737 | 3/1965 | United Kingdom | 35/35 J |

*Primary Examiner*—Gene Mancene
*Assistant Examiner*—Wenceslao J. Contreras
*Attorney, Agent, or Firm*—Young & Thompson

[57] ABSTRACT

This set of signs comprises four kinds of signs (1, 2, 3, 4). The first ones (1) have the shape of an independent letter. The second ones (2) correspond to the shape of beginning letters provided with a connecting member (6) to connect it to the next sign. The third ones (3) present the shape of middle letters provided with a connecting member (6) and with a recess (7). The fourth ones (4) correspond to the shape of end letters provided with a recess (7).

Through dry transfer of such signs one may compose a perfect text in Arabic letters.

5 Claims, 7 Drawing Figures

SET OF SIGNS TO COMPOSE TEXTS IN ARABIC LETTERS BY THEIR JUXTAPOSITION

The present invention relates to a set of signs to compose texts in Arabic letters by means of their juxtaposition.

There are now Arabic letters intended to be used by dry transfer to create Arabic texts. These existing letters have exactly the same shapes as the ones used for the corresponding printing character. The linkage between these letters is obtained by the junction of their horizontal bar, the ends of which are cut vertically.

The drawback of such a system is that it is very difficult to join these horizontal portions without vertical misalignment so that the linkage between two letters so obtained presents a discontinuity which can only very difficulty be corrected by retouching.

The aim of the present invention is to remedy this drawback. It has for its object a set of signs for the composition of texts in Arabic letters through their juxtaposition which is characterized by the fact that it comprises four kinds of signs; the first ones having the shape of independent letters; the second ones corresponding to the shape of the beginning letters provided with a connecting member to connect them to the following sign; the third ones corresponding to the shape of middle letters provided on the one hand with a recess and on the other hand with a connecting member to connect them to the following signs, and the fourth ones corresponding to the shape of end letters provided with a recess.

The attached drawings show schematically and by way of example one embodiment of a set of signs according to the invention.

FIG. 1 shows the shapes now used in dry transfer. a is a beginning letter, b a middle letter and c an end letter.

The shapes of these letters correspond to the printing characters generally used and are limited at the point where they have to be connected to other letters by a vertical rectilinear cut.

Figure 1:
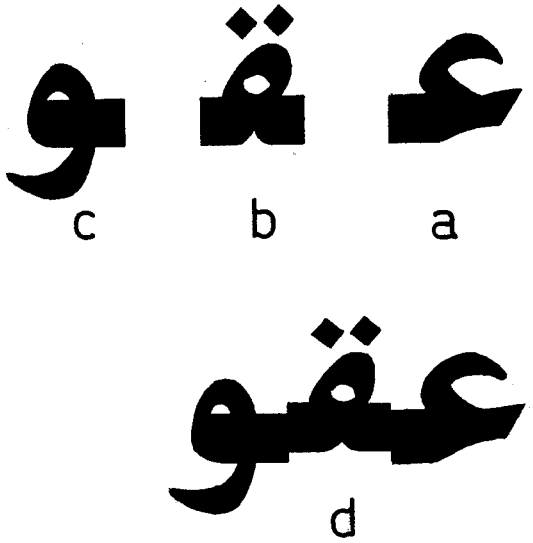
FIG. 1 shows the existing letters used in dry transfer. a is a beginning letter, b a middle letter and c an end letter. d shows the junction of these letters having the precited defect.

In order to make the composition of a text with these letters, it is necessary to join them with a great precision and even then it is frequent to have defects which cannot be rectified even by retouching, the junction of the letters being not aligned. A composition as shown in d in FIG. 1 is obtained which is not acceptable. To obtain a usable composition with such letters it is necessary to have qualified workers and give a very great attention to the work done. This leads to loss of time. This is why in the countries writing in Arabic letters one uses, despite of the existing system, qualified persons to write manually.

Figure 2:
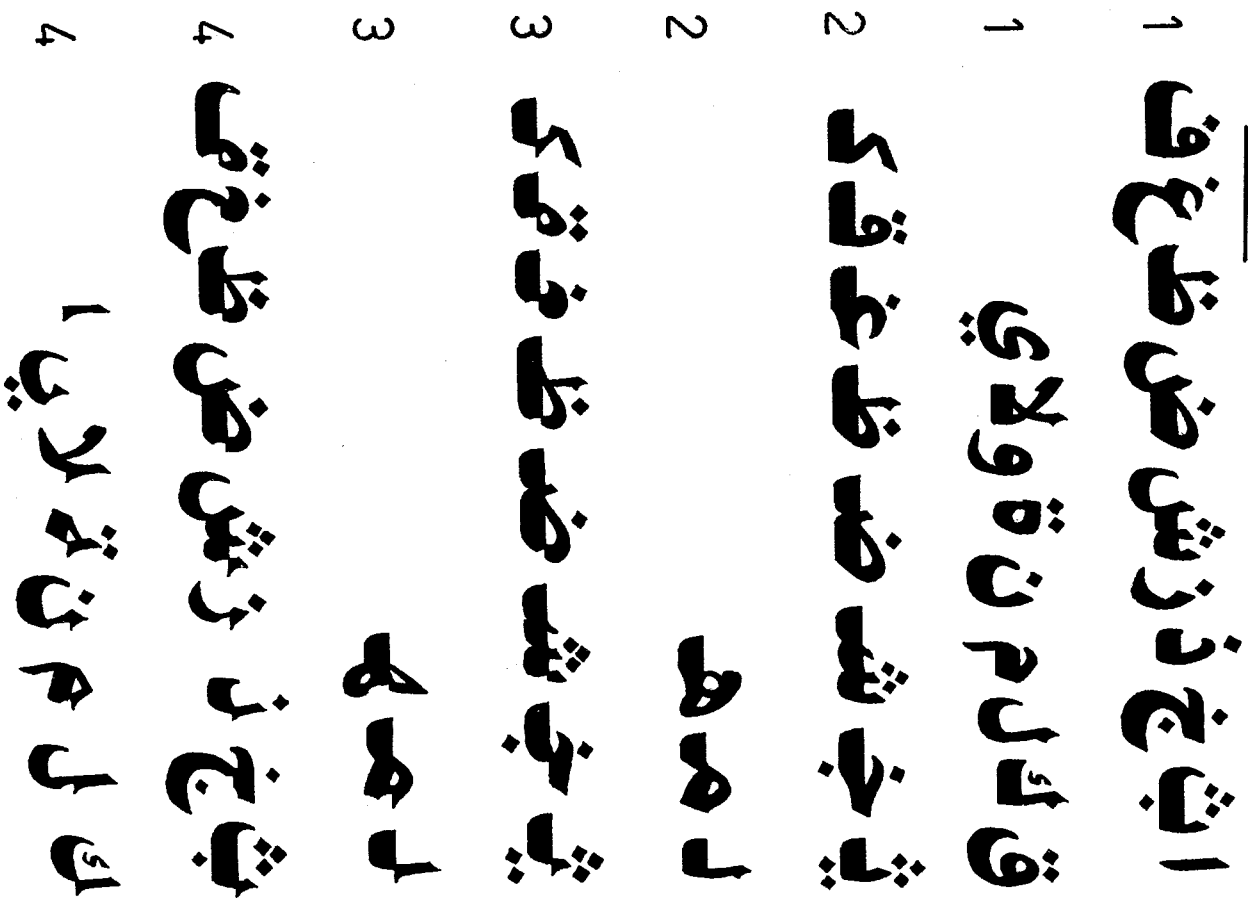
FIG. 2 shows a set of signs according to the present invention.

The set of signs for the composition of texts in Arabic letters shown in FIG. 2 permits one to avoid completely these drawbacks. The set shown corresponds to the shapes of the letters of a complete alphabet.

This set comprises four kinds of signs. The first ones (1) the shape of which corresponds to the shape of the independent letters of the Arabic alphabet.

The second signs 2 correspond to the shape of the beginning letters provided with a connecting member 6. This connecting member 6, as seen here below, constitutes a part of a letter which follows this sign.

The third signs 3 correspond to the shape of the middle letters provided on one hand with a recess 7 and on the other hand with a connecting member 6.

Finally the fourth signs 4 correspond to the shape of end letters provided with a recess 7.

Figure 3:
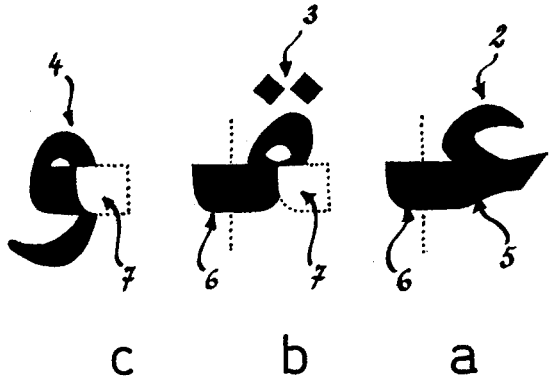
FIG. 3 shows in a a sign representing a beginning letter provided with its connecting member; in b a sign representing a middle letter provided with its recess and its connecting member and in c a sign representing an end letter with its recess.

FIG. 3*a* shows a sign of the second kind which represents a letter 5 provided with a connecting member 6. The end of this connecting member 6 has an inclined or rounded shape which can represent a part of the rising shape of the following letter.

FIG. 3*b* shows a sign of the third kind which represents a middle letter provided on one hand with a connecting member 6 and on the other hand with a recess or void 7 intended to be completed or filled by the connecting member 6 of a preceeding sign.

FIG. 3*c* shows a sign of the fourth kind which represents an end letter provided with a recess 7.

Figure 4:
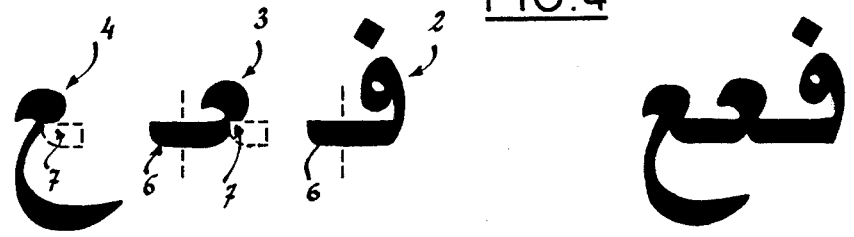
FIGS. 4 to 7 show the junctions obtained with the signs according to the invention.

FIG. 4 shows three signs of the second, third and fourth types or kinds, on the one hand separately and on the other hand linked the one to the other to make a word. When they are joined together the three signs compose three letters, the connecting members 6 being placed in, and filling, the recesses 7 of the following sign. In this example the ends of the connecting members 6 are partially visible and constitute a portion of the beginning of the rising portion of the next letter.

Figure 5:
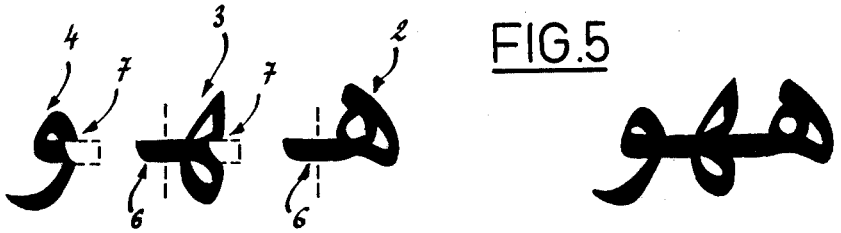

In the example shown in FIG. 5, the end of the connecting members 6 completely disappears in filling the recesses 7, to complete the horizontal bar linking the letters together.

Figure 6:
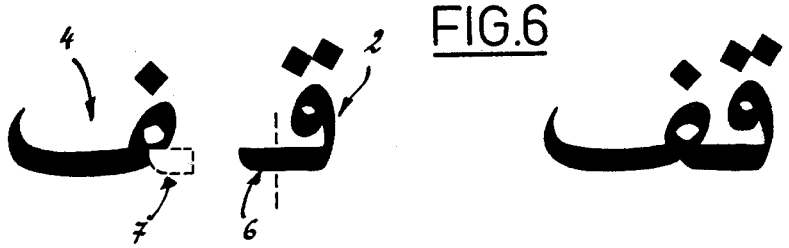

In FIG. 6 the end of the connecting member 6 of the sign 2, when located within the recess 7 of the sign 4 appears slightly only to form the beginning of the slightly rising portion of the following letter.

Figure 7:
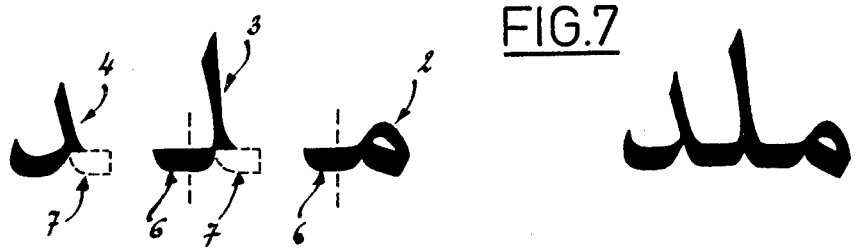

In FIG. 7 the end of the connecting member 6 of the signs 2 and 3, when filling the recesses 7 of the signs 3 and 4, are completely visible and form the beginning of the rising portion of the following letter.

This system has the following advantages:

a. Complete elimination of the defect of the horizontal bar located between two linked letters.
b. It makes it possible to compose perfectly correct texts by non skilled persons.
c. The composition speed is increased since the defects of the junctions are not visible when two black portions are juxtaposed and can be easily removed by retouching if the recess 7 is not completely filled by the connecting member.

In other types of characters the end of the connecting member 6 can have other shapes, for example an oblique straight line. In these cases the shape of the recesses is modified accordingly.

It is evident that this linkage system of Arabic letters can be used in writing texts in Arabic, Farsi, Pakistani and so on, or of any other language using Arabic letters.

While the invention has been described in detail and with reference to specific embodiments thereof, it will be apparent to one skilled in the art that various changes and modifications can be made therein without departing from the spirit and scope thereof.

What I claim is:

1. A two-dimensional set of signs for the composition by dry transfer of texts in Arabic letters through their juxtaposition which is characterized by the fact that it comprises a sheet of dry transfer material having thereon four kinds of signs; the first ones having the shapes of independent letters; the second ones corresponding to the shapes of the beginning letters provided with a connecting member comprising a protrusion on the visible outline of the letter to connect them to the following sign; the third ones corresponding to the shape of middle letters provided on one hand with a recess in the visible outline of the letter and on the other hand with a said connecting member to connect them to the following sign, and the fourth ones corresponding to the shape of end letters provided with a said recess, said connecting members and said recesses being so shaped as to interfit.

2. A set of signs as claimed in claim 1 characterized by the fact that when two signs of the second, third or fourth kind are assembled, the end of the connecting member is not visible and is part of the linkage bar connecting two letters obtained therewith.

3. A set of signs as claimed in claim 1 characterized by the fact that when two signs of the second, third or fourth kinds are assembled, the end of the connecting member is completely visible and constitutes the beginning of the rising portion of the following letter.

4. A set of signs as claimed in claim 1 characterized by the fact that when two signs of the second, third or fourth kinds are assembled, the end of the connecting member is partially visible only and constitutes the beginning of the rising portion of the following letter.

5. A set of signs as claimed in claim 3 or 4 characterized by the fact that the more the shape of the following letter is approaching to vertical, the greater is the visible part of the end of the connecting member.

* * * * *